US005301915A

United States Patent [19]

Bahniuk et al.

[11] Patent Number: 5,301,915

[45] Date of Patent: Apr. 12, 1994

[54] COMPUTER NOTE HOLDER BOARD

[75] Inventors: Douglas E. Bahniuk, Cleveland Heights; Dominic Valentino, Cleveland, both of Ohio

[73] Assignee: Adelsys, Inc., Cleveland Heights, Ohio

[21] Appl. No.: 955,030

[22] Filed: Oct. 1, 1992

[51] Int. Cl.[5] ..... A47B 97/04

[52] U.S. Cl. ..... 248/452; 248/442.2; 248/918

[58] Field of Search ..... 248/452, 451, 453, 442.2, 248/918; 400/718

[56] References Cited

U.S. PATENT DOCUMENTS

| | | | |
|---|---|---|---|
| 4,475,705 | 10/1984 | Henneberg et al. | 248/451 X |
| 4,693,443 | 9/1987 | Drain | 248/918 X |
| 4,767,093 | 8/1988 | Jones | 248/452 X |
| 4,849,612 | 7/1989 | Stahre | 400/718 X |
| 5,035,392 | 7/1991 | Gross et al. | 248/442.2 |
| 5,044,593 | 9/1991 | Jones | 248/442.2 |
| 5,082,235 | 1/1992 | Crowther et al. | 248/442.2 X |
| 5,122,941 | 6/1992 | Gross et al. | 248/442.2 X |
| 5,125,612 | 6/1992 | McNeal | 248/442.2 |

*Primary Examiner*—Ramon O. Ramirez

[57] ABSTRACT

A note holder board which comprises a support means to be secured to the top or side of a monitor screen and an extending panel the bottom of which interconnects with the support means forming a pivot which is adjustable through hand pressure on a holding apparatus.

7 Claims, 2 Drawing Sheets

COMPUTER NOTE HOLDER BOARD

BACKGROUND OF THE INVENTION

The present invention is directed to a board for holding notes, messages, and the like on a monitor or display screen or any other conspicuous place.

The relevant prior art appears to deal with message or note holders that are specifically concerned with methods of maintaining paper such as clips. Other prior art concerns copyholders that are specially designed to hold full sized sheets of paper next to a monitor screen and are not suitable for attachment of a multitude of smaller note sized sheets.

With the proliferation of computer technology, word processors and personal computers have become common in business offices. Because the displays of such devices are the focus of the users' attention, users attach note papers and memos to the display, thereby cluttering and obscuring the display itself. Hence, it is desirable to provide for a note holder board that allows notes or messages to be placed adjacent to a monitor screen, thereby reducing clutter and obstruction of the display.

SUMMARY OF THE INVENTION

The invention relates to a note holder board. In particular, the invention concerns a note holder board that provides for the attachment of notes or messages adjacent to a monitor screen. The note holder board assembly is preferably constructed of two pieces of extrusion formed plastic that slide together forming a hinge.

One portion of the assembly is an extending panel which has a smooth surface thereby allowing the placement of either self-adhering note papers or note papers attached by tape. The thickness of the extending panel is such that note papers can also be attached using one of the low cost clips which are already being produced in high volume.

The remaining portion of the assembly is a support means which is mounted adjacent to a monitor screen and acts a base for the extending panel. The support means also acts to hold note papers in lieu of the attachment methods described earlier by incorporating a groove that holds note or message papers that are placed therein.

For a more complete understanding of the invention and the objects and advantages thereof, reference should be made to the accompanying drawings and the following detailed description wherein preferred embodiments of the invention are illustrated and described.

DESCRIPTION OF THE EMBODIMENTS

Figure 2:
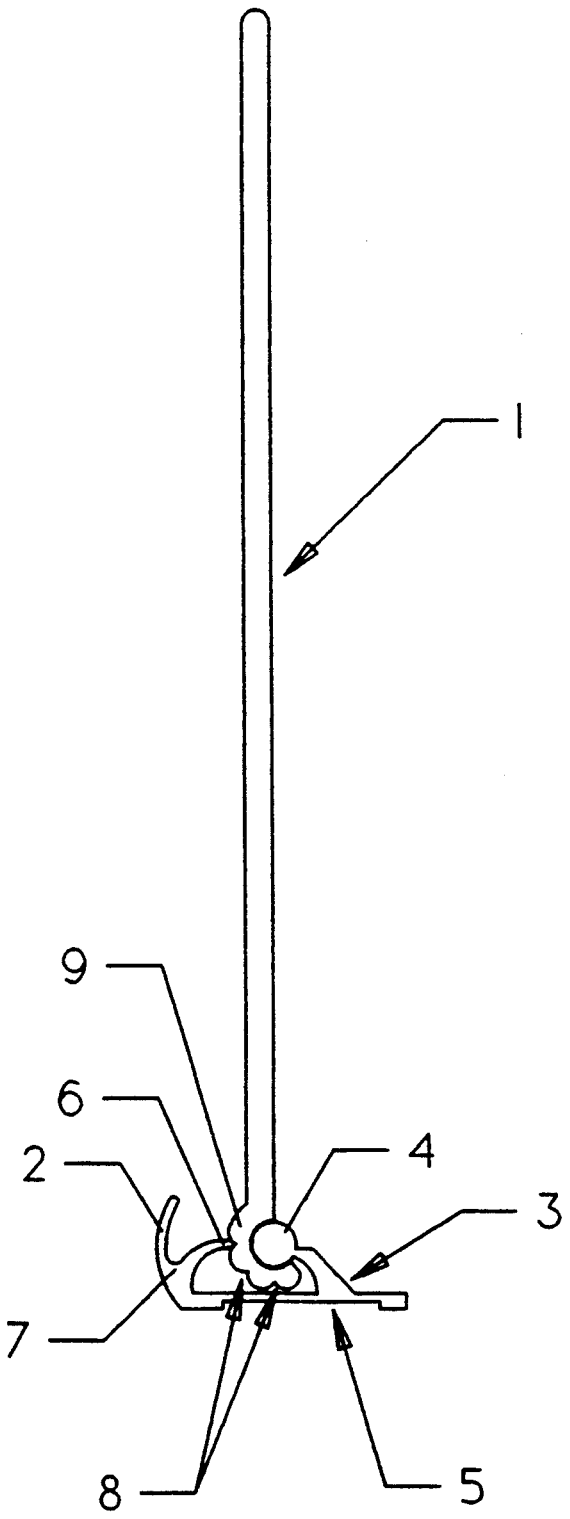
FIG. 2 is a sectional view of the note holder taken along the line 15—15 of FIG. 1.

Referring to the accompanying drawings and initially to FIG. 2, there is shown a note holder board according to the present invention comprising an extending panel 1 and a support means 3.

Support means 3 forms a channel 5 which acts as a recess to accept a strip of hook and loop fastening means such that as sold under the trademark "VELCRO" which allows it to be attached to a monitor screen or other surface which has likewise, had a strip of hook and loop fastening means been attached to it.

An alternative fastening means would be to use double sided tape in channel 5. The support means 3 is adapted to allow for pivotal movement of the extending panel 1 by way of a hinge resulting from the partial encirclement of the pin structure 4 by the groove structure 9 formed at one end of the extending panel.

The angular position of the extending panel 1 is maintained by way of a resiliently biased means 6 which permits adjustment to set angles determined by placement of 6 into one of the angle slots 8. In use, when the angular position of the extending panel 1 needs to be adjusted, the user pulls the holding apparatus 2 outwardly so that the force applied by the resiliently biased means 6 is diminished. Thus allowing the groove structure 9 and hence the extending panel 1 to pivot.

Figure 1:
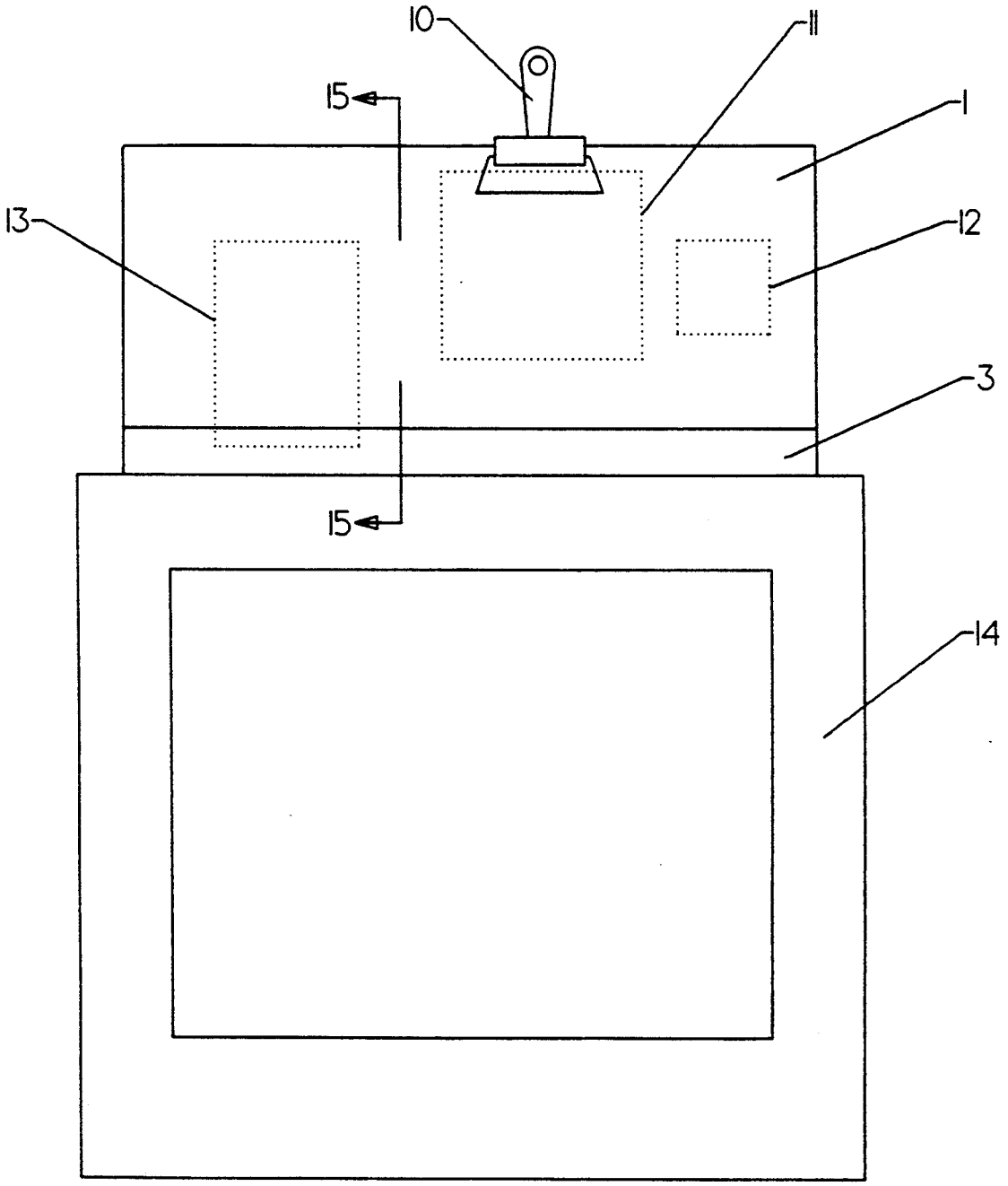
FIG. 1 is a front elevational view of a note holder board of the invention secured to the top of a monitor screen with various note papers held in position.

With reference to the preferred embodiment shown in FIG. 1, there is shown a note holder board mounted to a monitor screen 14. Also illustrated is the placement of a self-adhering note paper 12 shown in dotted lines and may be such as sold under the trademark "post-it" manufactured by 3M. Another sheet of note or message paper 11 is shown attached to the note holder board by means of a resiliently biased clip 10 such as a bulldog clip. Yet another sheet of note or message paper 13 is maintained in position by resting in slot 7 of FIG. 2 which is formed as part of the holding apparatus 2.

Various modifications and improvements may be made without departing from the present invention defined in the appended claims. For example, an alternative embodiment would be to mount the support means 3 on the side of a monitor screen instead of on top as illustrated in FIG. 1. Also, the use of a separate clip 10 could be eliminated by stamping holding tabs into the extending panel 1.

I claim:

1. A note holder board adapted to hold note papers adjacent to an office machine comprising in combination:
   (a) a support means to be secured adjacently to a monitor screen;
   (b) an extending panel, connected to said support means, having a surface allowing attachment of self-adhering note papers;
   (c) means to provide pivotable movement of said extending panel at one end thereof, comprising of a resiliently biased holding apparatus to maintain angle adjustment of said extending panel, and to permit said extending panel to be pivotally moved to various angles in relation to said support means; and
   (d) means to hold papers without adhesives or mechanical fasteners.

2. The note holder board defined by claim 1 wherein said extending panel forms a longitudinal recess to accept at least one spring-biased pivotal jaw clamp.

3. The note holder board defined by claim 1 wherein said support means includes a channel to accept a fastening means to attach said note holder board to a surface.

4. The note holder board defined by claim 1 wherein said extending panel is formed by material extrusion.

5. The note holder board defined by claim 1 wherein said support means is formed by material extrusion.

6. The note holder board defined by claim 1 wherein said extending panel is formed by plastic extrusion.

7. The note holder board defined by claim 1 wherein said support means is formed by plastic extrusion.

* * * * *